United States Patent [19]

Bogar et al.

[11] Patent Number: 4,861,271

[45] Date of Patent: Aug. 29, 1989

[54] RIGHT-ANGLE COAXIAL PLUG CONNECTOR

[75] Inventors: Jerry H. Bogar, Harrisburg; Willard F. Cassel, Jr., Mechanicsburg; Dale B. Mummey, Camp Hill; Carl D. Oberman, New Cumberland; Donald J. Summers, Shiremanstown, all of Pa.

[73] Assignee: AMP Incorporated, Harrisburg, Pa.

[21] Appl. No.: 131,307

[22] Filed: Dec. 7, 1987

Related U.S. Application Data

[63] Continuation of Ser. No. 932,253, Nov. 19, 1986, abandoned.

[51] Int. Cl.[4] ..... H01R 17/18

[52] U.S. Cl. ..... 439/63; 439/736; 439/675

[58] Field of Search ..... 439/736, 586–589, 439/595, 597, 598, 599, 600, 603, 374, 380, 381, 578–585, 675, 55, 63, 668, 669

[56] References Cited

U.S. PATENT DOCUMENTS

| | | | |
|---|---|---|---|
| 2,952,823 | 9/1960 | Robinson | 439/582 |
| 3,341,801 | 9/1967 | Brookman et al. | 339/18 |
| 3,432,798 | 3/1969 | Brishka | 339/177 R |
| 3,437,960 | 4/1969 | Ziegler Jr. | 339/177 R |
| 3,636,239 | 1/1972 | Robbins | 339/177 R |
| 4,125,313 | 11/1978 | Sipp et al. | 339/218 M |
| 4,451,107 | 5/1984 | Dola et al. | 339/143 R |
| 4,548,453 | 10/1985 | Mummey et al. | 339/17 C |
| 4,605,269 | 8/1986 | Cohen et al. | 339/17 L C |
| 4,614,926 | 9/1986 | Reed et al. | 333/244 |
| 4,659,156 | 4/1987 | Johnescu et al. | 339/17 C |

*Primary Examiner*—David Pirlot

*Attorney, Agent, or Firm*—Anton P. Ness

[57] ABSTRACT

A coaxial right-angle plug connector includes a "clean" right-angle inner contact member having a continuous insulative cover molded therearound including the bend to be self-retaining thereon and to have consistently concentric coaxial outer surfaces, with larger diameter cover portions around the portion within the conductive housing. The front horizontal contact portion and the outer contact therearound mate with contact means of conventional receptacle connectors, while the vertical portion of the inner contact descends from the housing near the front thereof reducing the length of the signal path and lessening reflection. The housed portion of the connector raises the average impedance over the length of the connector to approximate that of the cable used in the signal path of the coaxial patchboard programming system, by reason of large diameter cover portions of the inner contact adjacent the bend, while allowing floating of the insulated inner contact to adapt to a slightly misaligned printed circuit board hole.

2 Claims, 3 Drawing Sheets

RIGHT-ANGLE COAXIAL PLUG CONNECTOR

This application is a continuation of application Ser. No. 932,253 filed Nov. 19, 1986, now abandoned.

FIELD OF THE INVENTION

This relates to electrical connectors and more particularly to connectors for coaxial cable.

BACKGROUND OF THE INVENTION

Coaxial plug connectors are known from U.S. Pat. No. 4,548,453 which are mountable and electrically connectable to a circuit panel and which are right-angled to mate with receptacle connectors parallel to the circuit panel. Such right-angled plug connectors are useful to replace coaxial cable leads in coaxial patchboard systems for automatic test equipment for testing electronic circuit boards or cards. The inner or signal contact is right angled with a vertical portion extending downwardly from the conductive housing near its rearward end to be connected to a signal path of the circuit panel, while the horizontal portion extends forwardly from the front end to mate with a corresponding signal contact of a receptacle connector; premolded tubular dielectric plastic sleeves are placed over the horizontal and vertical contact portions. An outer ground contact extends coaxially around the insulated horizontal portion of the signal contact with a forward section extending from the conductive housing to mate with a corresponding ground contact of the receptacle connector. The rearward section of the outer ground contact is mechanically and electrically joined to the conductive housing, and a ground post extends downwardly from proximate the front end of the housing to be joined to a ground path of the circuit panel. One typical coaxial cable used with such a coaxial patchboard system is type RG-174/U and has a nominal impedance of 50 ohms.

It is desirable that a coaxial plug connector match or at least approximate the characteristic impedance of the cable, and the prior art connector disclosed in U.S. Pat. No. 4,548,453 does not optimize its ability to approximate the cable impedance. In practice, the inner and outer surfaces of the premolded dielectric sleeves are not consistently concentric about the contact-receiving bore therethrough, which affects impedance control of the assembled connector in use. Thinner-walled areas of the premolded sleeves are believed to result in areas of low impedance along the contact if it results in reduced separation between the inner and outer contacts, detracting from achievement of impedance control and matching. Also, the forward contact structure which mates with the receptacle connector has substantially lower impedance therealong than the cable, which compounds the impedance mismatch already existing due to the discontinuity of the connector and the right-angle bend.

It is also desirable to provide a dielectric covering around at least portions of the inner contact for radial spacing of the outer contact, which portions are secured in place along the inner contact without the necessity for structural features of the inner contact such as stop shoulders or projections which would act to lower the impedance or serve to reflect current or voltage or both, and without the necessity for tedious assembly including axially locating the covering along the contact and bonding it thereto.

It is further desirable to reduce reflection produced by a coaxial plug connector.

It is yet desirable that a coaxial plug connector be adapted to be mounted on a circuit panel whose contact-receiving holes may be slightly imprecisely arrayed so that the plurality of such coaxial plug connectors already in mated relationship with a multi-terminal receptacle connector can then be mounted on the circuit panel by its contacts being insertable into the circuit panel holes.

SUMMARY OF THE INVENTION

The present invention is a coaxial plug connector having a right-angled inner or signal contact with a profiled insulative cover molded thereover having concentric outer surfaces. The inner contact is clean, having a constant diameter and no annular collars or projections. An outer or ground contact concentrically surrounds a length of the horizontal portion of the insulated inner contact. Forward portions of both the inner and outer contacts extend forwardly of the front of a conductive housing to mate with inner and outer contacts of a receptacle connector. The insulated descending portion of the inner contact extends through an oversized hole in a bottom wall of the conductive housing near the front thereof. The outer contact is disposed within a cylindrical channel of the housing and mechanically joined thereto such as by soldering in electrical connection therewith. The inner contact is secured within the contact-receiving channel of the housing in a manner allowing limited movement within the connector; the float capability allows that the descending pin contact portion thereof extending through the oversized hole and below the housing is movable slightly in the horizontal plane to "find" and enter the corresponding hole of the circuit panel.

In one aspect of the present invention, the low impedance forward contact structure is maintained to mate with conventional receptacle connectors, and the remaining connector structure is modified to create high impedance such that the average impedance over the length of the connector is raised to approximate that of the cable. The length of the signal contact is minimized reducing reflection, by placing the vertical portion near the front of the connector. The diameters of the insulating cover within the housing proximate the right-angle bend are relatively large and consistently concentric resulting in increased impedance therealong.

In another aspect of the present invention, the right angle bend of the inner contact is utilized as a means to secure the dielectric cover in place on the inner contact, eliminating the need for retention features on the inner contact or tedious locating and bonding of the cover thereon. The covering is not held firmly in place by the outer contact or conductive housing or both such as by compression fit within bores, which permits the floating of the insulated inner contact within the outer contact/-housing.

It is an objective of the present invention to provide a profiled dielectric cover having consistently concentric large diameter outer surface portions about the inner contact member and along both its horizontal and vertical contact sections within the housing, secured in place to a clean inner contact.

It is another objective to decrease the length of the signal contact to reduce reflection produced by the impedance mismatch while maintaining the prior art forward contact structure matable with conventional receptacle connectors.

It is still another objective to secure the outer contact firmly to the housing while securing the inner contact slightly loosely therewithin.

DETAILED DESCRIPTION OF THE PREFERRED EMBODIMENT

Figure 1:
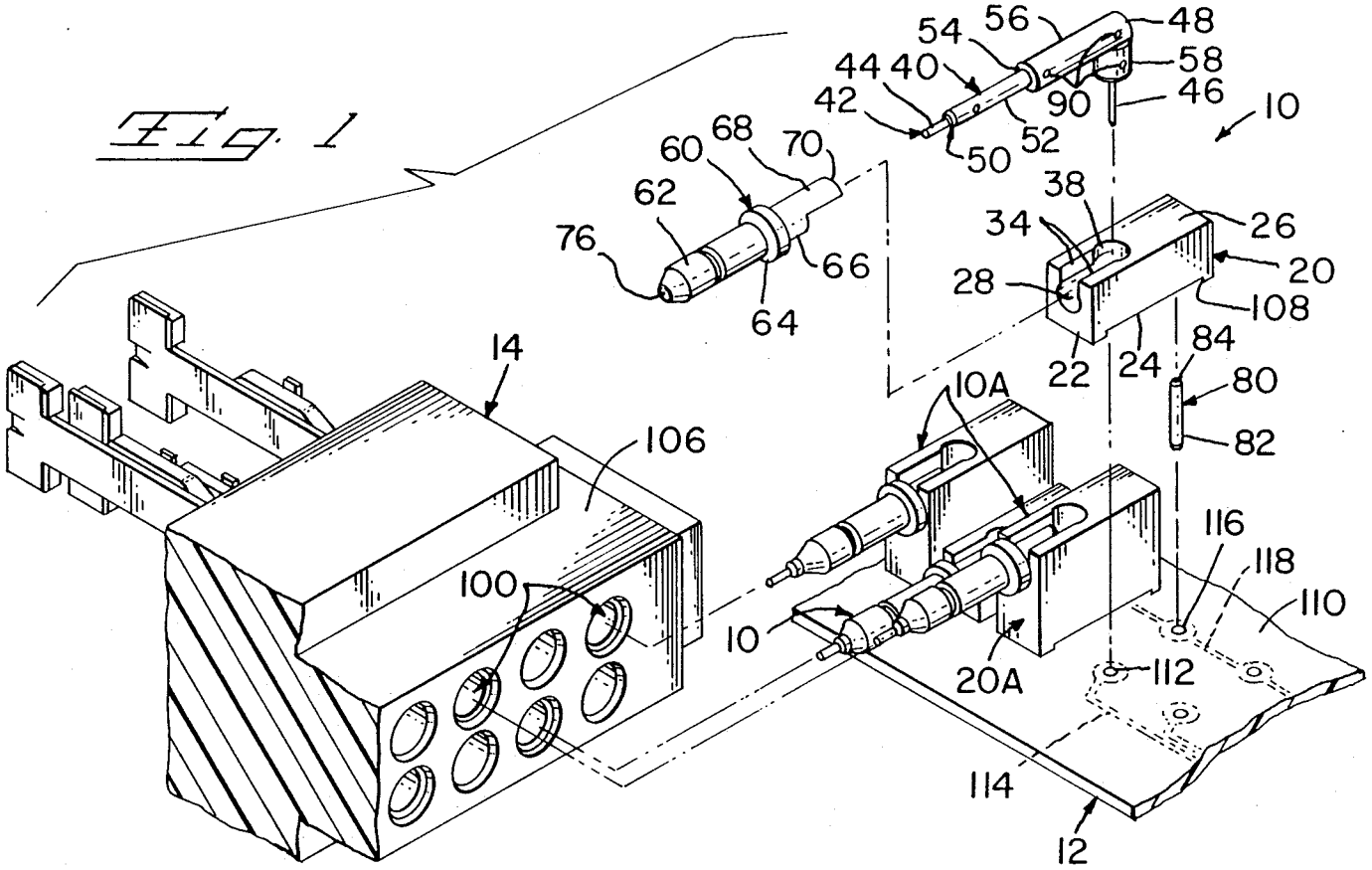
FIG. 1 is an assembled and exploded perspective view of the plug connector assemblies of the present invention mounted on a circuit panel and spaced from a mating connector.

FIG. 1 illustrates several plug connector assemblies 10,10A of the present invention mounted on a circuit panel 12, spaced from a mating coaxial connector assembly 14 and having two alternating selected heights to correspond to contact rows in assembly 14. One connector assembly 10 is shown exploded from panel 12 and comprising a conductive housing member 20, an insulated inner contact 40, an outer contact member 60 and a ground post 80.

Insulated inner contact 40 includes inner contact member 42 having a constant diameter and tapered ends for lead-in benefits, and having a forward contact section 44 from the rearward end of which rear or vertical contact section 46 extends at right angles at bend 48. A profiled dielectric cover 50 is molded over a major portion of inner contact member 42 including bend 48 and adjacent portions of forward and rearward contact sections 44,46. Forward cover portion 52 extends most of the length of forward contact section 44 forwardly of stop surface 54 defined by the end of larger diameter intermediate cover portion 56. Vertical cover portion 58 covers part of vertical contact section 46 and extends downwardly from intermediate cover portion 56 joined integrally thereto at bend 48. Outer surfaces of cover portions 52,56,58 are coaxial with inner contact member 42.

Figure 2:
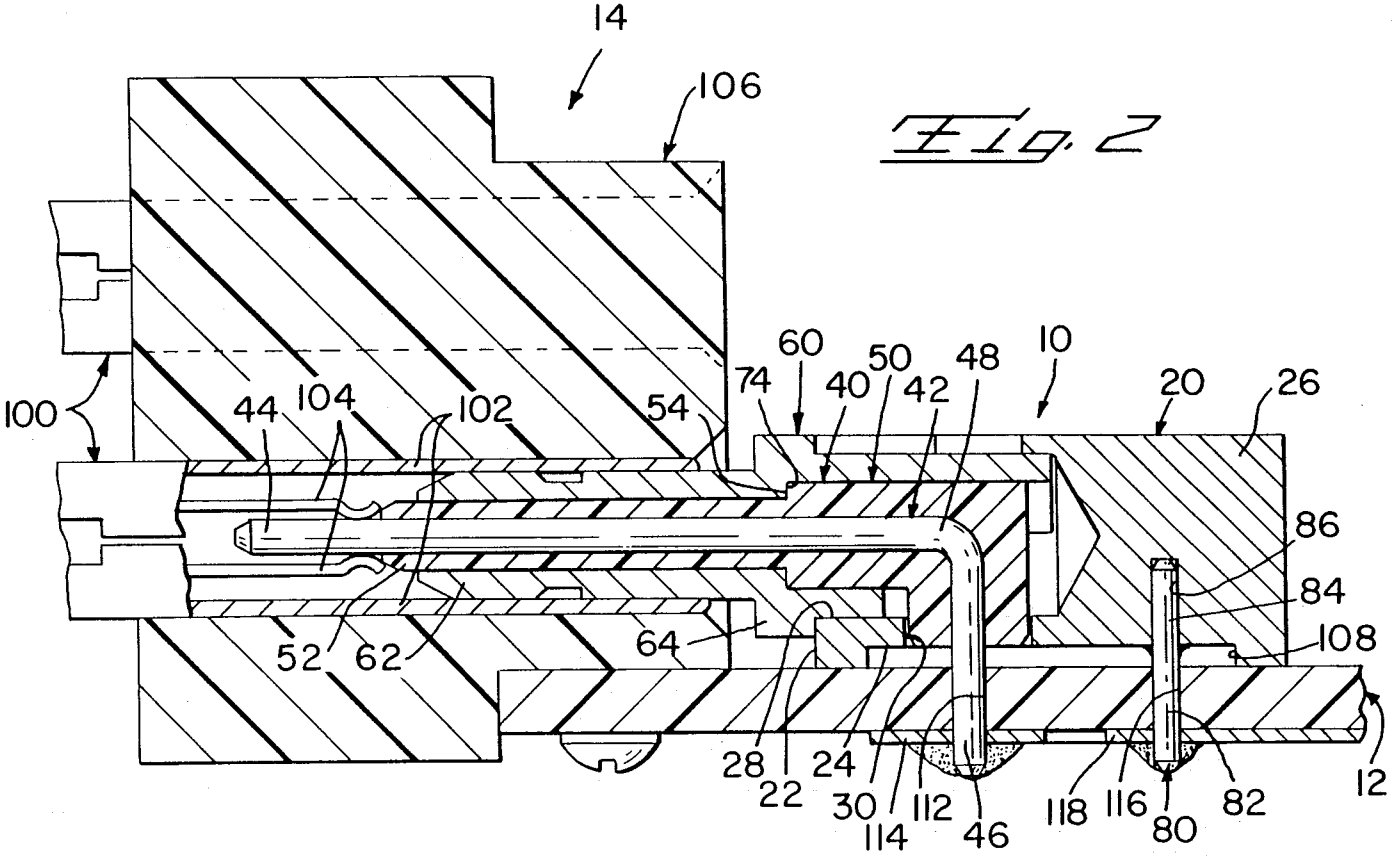
FIGS. 2 and 3 are longitudinal section views of an assembled and an exploded connector of FIG. 1, respectively.
Figures 3, 4:
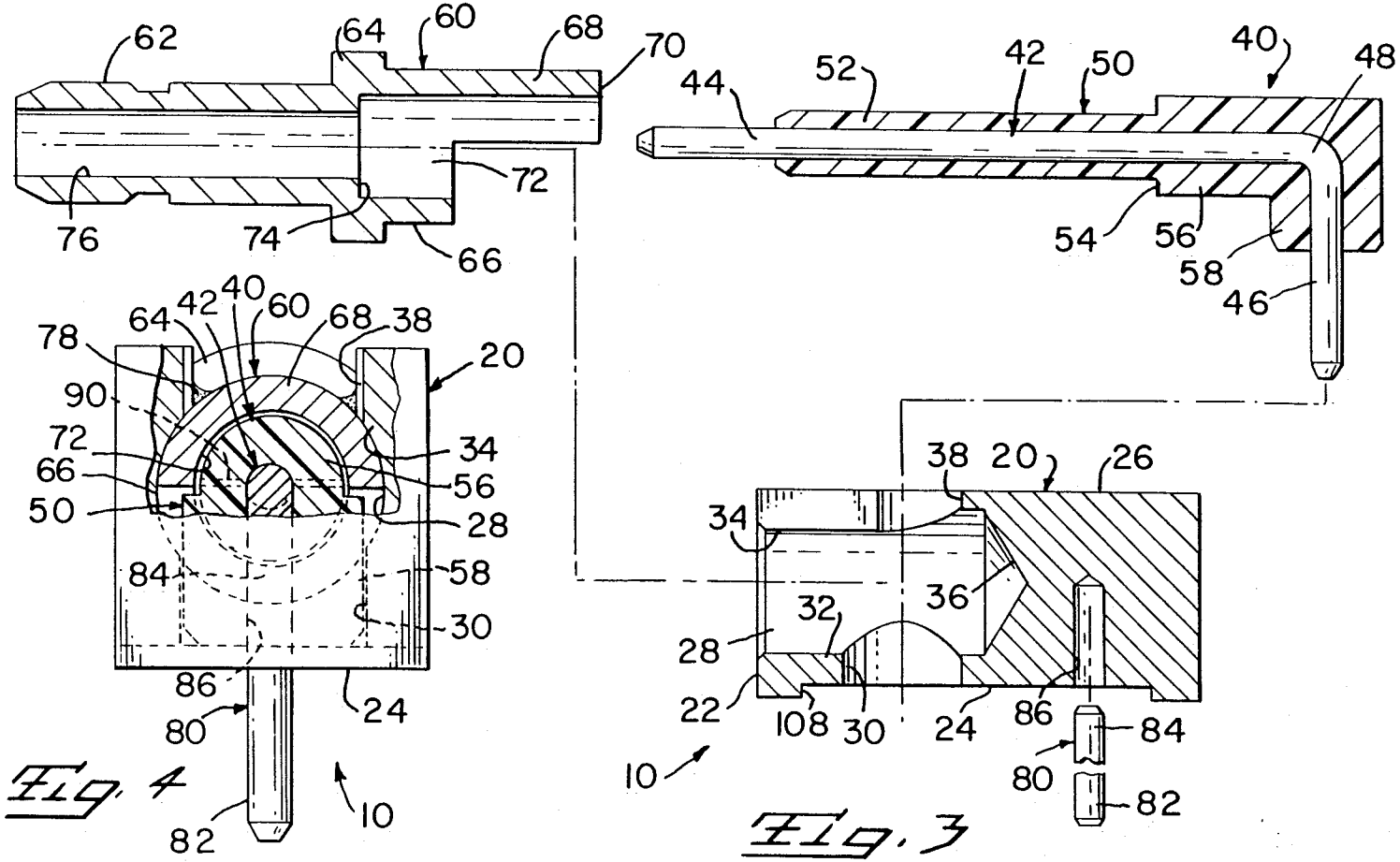
FIG. 4 is a part cross-sectional view of the plug connector of FIG. 2 from rearwardly thereof.

Referring to FIGS. 1 to 3, forward contact section 44 with forward cover portion 52 therearound extends forwardly of mating face 22 of housing member 20. Outer contact member 60 has a forward section 62 which coaxially surrounds most of the covered length of forward contact section 44 and extends forwardly of mating face 22 of housing member 20, and forward contact section 44 farther forwardly, both to electrically engage corresponding outer and inner contact sections 102,104 of a mating coaxial receptacle connector 100 secured in connector block 106 of coaxial connector assembly 14 such as that disclosed in U.S. Pat. No. 3,341,801. Mounting face 24 of housing member 20 preferably has lands 108 which engage top surface 110 of circuit panel 12 to space connector 10 a distance therefrom for purposes of providing a gap to reduce the transfer of heat from the bottom of the circuit panel during wave soldering, and to facilitate solder flux removal after assembly. Vertical contact section 46 of inner contact member 42 extends below mounting face 24 of housing member 20 to extend through a hole 112 of circuit panel 12 and terminated thereunder to a conductive signal path 114 or other contact means thereof such as by soldering.

In FIG. 2 lower section 82 of ground post 80 extends below mounting face 24 to extend through a hole 116 of circuit panel 12 to be terminated thereunder to a conductive ground path 118 or other ground contact means thereof. Upper section 84 of ground post 80 is soldered in blind hole 86 of housing member 20 extending upwardly from mounting surface 24 into rear body section 26 of housing member 20.

Housing member 20 is preferably a machined metal member having a contact-receiving channel 28 disposed in the front half thereof, extending rearwardly from mating surface 22 to rear body section 26. Hole 30 extends through channel bottom 32 adjacent rear body section 26, and has a larger diameter than the outer diameter of vertical cover portion 58 and therefore is oversized. Channel 28 is cylindrical in cross-section and is in communication with the top surface of housing 20 therealong; upper wall portions 34 extend arcuately inwardly and serve to secure outer contact member 60 within channel 28 especially during assembly prior to soldering. Just forwardly of rearward channel end 36 is an aperture 38 also extending through the top surface from channel 28 and axially aligned with and dimensioned equally to hole 30 below, to provide for receipt of insulated inner contact 40 into channel 28 during assembly. In taller connector assembly 10A, housing member 20A has a greater dimension between its channel bottom and its mounting face, and a correspondingly longer oversized hole through which the respective covered rearward contact section will extend.

Outer contact member 60 includes an annular collar 64 intermediate thereof extending outwardly at the rear of forward section 62 and which will be disposed against mating face 22 of housing member 20. Rearwardly from forward section 62 extends short cylindrical portion 66, and a semicylindrical sleeve portion 68 continuing rearwardly from the top thereof to rearward end 70. Stepped bore 72 extends forwardly through outer contact member 60 coaxial with the inner surface of semicylindrical sleeve portion 68, with rearwardly facing stop surface 74 disposed within annular collar 64. Forward bore portion 76 is dimensioned to fit around forward cover portion 52, and short cylindrical portion 66 is dimensioned to fit around intermediate cover portion 56. Stop surface 54 of cover 50 is held behind stop surface 74 of outer contact member 60. Vertical cover portion 56 extends normally downwardly from semicylindrical sleeve portion 68 to extend just through oversized hole 30 of housing member 20.

Referring to FIGS. 3 and 4, connector 10 is assembled by placing insulated inner contact 40 into housing 20 from atop thereof so that vertical contact section 46 with vertical cover portion 58 therearound can be inserted through aperture 38 and then extend through hole 30 thereof, and then placing outer contact member 60 around insulated inner contact 40 from forwardly thereof into contact-receiving channel 28 of housing member 20. Rearward end 70 of semicylindrical sleeve portion 68 extends beyond the rearward end of intermediate cover portion 56 of insulated inner contact 40 to rearward end 36 of contact-receiving channel 28. After placement of the contact members into channel 28, outer contact member 60 is soldered to housing member 20 at joints 78 to hold it firmly therewithin (thereby holding insulated inner contact 40 loosely in housing 20) and also to establish an assured electrical connection between outer contact member 60 and housing member 20. Joints 78 may optionally be enhanced by secondary bonding such as with epoxy resin.

Insulated inner contact 40 preferably has its intermediate cover portion 56 and vertical cover portion 58 (and the adjacent outer contact member surfaces) possessing a large diameter to increase the average impedance over the length of the connector to match the cable impedance (such as 50 ohms). The structures and dimensions of both the inner and outer contact members forwardly of the conductive housing must remain unchanged from the prior art to mate with existing receptacle connectors, and these existing structures and dimensions are known to create low impedance therealong. For example, where the diameter of inner contact member 42 is 0.032 inches continuously therealong (and comprising the inside diameter of cover 50), and the outer diameter of forward cover portion 52 is 0.064 inches to mate with existing receptacle connectors for a 50 ohm impedance cable, intermediate cover portion 56 preferably has an outer diameter of 0.103 inches and vertical cover portion an outer diameter of 0.120 inches; and the dielectric constant of the polypropylene cover 50 is 2.3. The characteristic impedance of the portions of the coaxial plug connector 10 of the example is calculated to be about 27 ohms forwardly of mating face 22 of housing 20, while within the housing it is calculated to be about 46 ohms forwardly of bend 48 and about 52 ohms downwardly from the bend; impedance at the bend itself is believed to be low, however. Reduction in the length of the signal path results in improved performance because it minimizes the length of the discontinuity and reduces the resulting reflection of current and voltage. And reducing the length of the signal path and raising the average impedance along the connector length improves the Voltage Standing Wave Ratio (VSWR) of the entire signal path of the coaxial patchboard assembly.

The outside diameters of the molded cover can be made concentric and coaxial with the inner contact member during overmolding by use of several locating pins along the length of the inner contact member locating it precisely centered in the mold cavity during molding (not shown). This leaves corresponding small radial holes 90 in the cover which fill with air, an excellent dielectric, and do not detract from the in-service performance of the insulated inner contact nor from its assembly. Cover 50 is securely maintained on inner contact member 42 by the overmolding process which assures that its concentric outer surfaces properly locate outer contact member 60 therearound at any axial location and still allow slight floating movement therewithin, all without special retention or location features of the inner contact such as annular collars, or additional parts, or a special assembly process, or all of these.

The inner diameters of the forward and short cylindrical portions 76 and 66 of bore 72 of the outer contact member 60 are selected to be just larger than the corresponding outer diameters of cover portions 52,56 to allow slight rotational movement of insulated inner contact 40 within stepped bore 72. Also, with the distance between stop surface 74 along stepped bore 72 and rearward end 70 of semicylindrical sleeve portion 68 being greater than the length of intermediate cover portion 56, limited axial movement of insulated inner contact 40 is permitted. Thus, floating can occur of vertical contact section 46 within oversized hole 30 of housing member 20 by reason of the annular gap between the hole and the outside surface of vertical cover portion 58. This permits vertical contact section 46 to enter a slightly off-center hole 112 in circuit panel 12 especially since ground post 80 must be firmly secured to housing member 20.

It is preferred that inner contact member 42, ground post 80, outer contact member 60 and housing 20 all be made of brass such as Copper Alloy 360 and plated with gold flash over nickel. Alternatively, housing member 20 may be plastic with all exterior surfaces and blind hole 86 suitably metal plated as is known, with conductive epoxy resin bonding ground post 80 and outer contact member 60 thereto. It is preferred that cover 50 be molded of polypropylene which is more resistant to temperatures involved in the soldering operations and also has a satisfactory dielectric constant for the impedance control aspects of the present invention.

There are variations which may be made by the skilled artisan to the present invention not expressly disclosed herein, which nevertheless are within the spirit of the invention and the scope of the claims.

What is claimed is:

1. A coaxial plug connector of the type mountable to a circuit panel and matable with a receptacle connector parallel to the circuit panel to complete a signal path of a coaxial system having a nominal impedance, and having an inner right-angle contact member having a horizontal portion extending rearwardly from a first pin contact section matable with inner contact means of the receptacle connector, and having a vertical portion joined to the horizontal portion at a bend and extending to a second pin contact section insertable into a hole of the circuit panel in electrical engagement with a corresponding contact means thereof, the inner contact member having a dielectric cover means therearound having an outer surface concentric with the inner contact member and including a horizontal cover portion around portions of the horizontal inner contact portion and a vertical cover portion around portions of the vertical inner contact portion, an outer contact member having a centered bore through which extend insulated horizontal portions of the inner contact member and including a forward section matable with outer contact means of the receptacle connector and further including means shielding the top of the inner contact member therealong, and a conductive housing having a channel extending thereinto from the top and front surfaces thereof to receive the inner and outer contact members thereinto with forward sections thereof extending forwardly of the housing, said housing including a vertical hole extending through the housing bottom and in communication with the channel through which extends the insulated vertical portion of the inner contact member, with the outer contact member mechanically and electrically joined to the conductive housing, the bottom of the conductive housing further including a vertical depending ground post insertable into a corresponding hole of the circuit panel in electrical engagement with a ground means thereof, said coaxial plug connector characterized in that:

said dielectric cover means is self-retaining on said inner contact member, said vertical hole communicating with said channel of said housing has a diameter slightly larger than the outer diameter of said vertical cover portion disposed therethrough, said centered bore of said outer contact member has a rearwardly facing stop surface corresponding to a forwardly facing stop surface defined by said horizontal cover portion therealong and located slightly forwardly of said forwardly facing stop surface after assembly, and said centered bore is slightly larger than said horizontal cover portion therealong whereby said covered inner contact member is slightly movable after assembly within said outer contact member and said conductive housing.

2. A coaxial plug connector of the type mountable to a circuit panel and matable with a receptacle connector parallel to the circuit panel to complete a signal path of a coaxial system having a nominal impedance, and having an inner right-angle contact member having a horizontal portion extending rearwardly from a first pin contact section matable with inner contact means of the receptacle connector, and having a vertical portion joined to the horizontal portion at a bend and extending to a second pin contact section insertable into a hole of the circuit panel in electrical engagement with a corresponding contact means thereof, the inner contact member having a dielectric cover means therearound including a horizontal cover portion and a vertical cover portion covering the horizontal and vertical inner contact portions respectively, an outer contact member having a centered bore through which extend insulated horizontal portions of the inner contact member and including a forward section matable with outer contact means of the receptacle connector and further including means shielding the top of the inner contact member therealong, and a conductive housing having a channel extending thereinto from the top and front surfaces thereof to receive the inner and outer contact members thereinto with forward sections thereof extending forwardly of the housing, said housing including a vertical hole extending through the housing bottom and in communication with the channel through which extends the insulated vertical portion of the inner contact member, said coaxial plug connector characterized in that:

said dielectric cover means is self-retaining on said inner contact member and is shaped and dimensioned so that said insulated inner contact member is adapted to receive said outer contact member onto said insulated horizontal portion from forwardly thereof;

said contact-receiving channel is in communication with a top surface of said conductive housing therealong and is cylindrical having upper portions of the side walls of said channel extending partially inwardly defining a spacing therealong dimensioned greater than the outer diameter of said insulated inner contact member and less than the outer diameter of said outer contact member, to receive said inner contact member thereinto from said top surface during assembly and to receive thereinto at least said outer contact member from a forward end of said housing over said insulated horizontal portion of said inner contact disposed within said contact-receiving channel, whereby said upper wall portions vertically retain said outer contact member within said housing after assembly while enabling assembly of said inner and outer contacts into said housing.

* * * * *